US006823544B2

(12) United States Patent
Treece

(10) Patent No.: US 6,823,544 B2
(45) Date of Patent: Nov. 30, 2004

(54) FITTED MATTRESS PAD AND METHOD OF FORMING A FITTED MATTRESS PAD

(75) Inventor: Terry Y. Treece, Anderson, SC (US)

(73) Assignee: Perfect Fit Industries, Inc., Charlotte, NC (US)

( * ) Notice: Subject to any disclaimer, the term of this patent is extended or adjusted under 35 U.S.C. 154(b) by 0 days.

(21) Appl. No.: 10/374,885

(22) Filed: Feb. 26, 2003

(65) Prior Publication Data

US 2004/0163174 A1 Aug. 26, 2004

(51) Int. Cl.[7] ..... A47G 9/04
(52) U.S. Cl. ..... 5/497; 5/500; 5/502; 5/482
(58) Field of Search ..... 5/482, 497, 499, 5/500, 502, 498, 691

(56) References Cited

U.S. PATENT DOCUMENTS

| | | | | |
|---|---|---|---|---|
| 2,499,698 A | | 3/1950 | Thomas | |
| 2,569,627 A | | 10/1951 | Black | |
| 2,856,615 A | | 10/1958 | Cirocco | |
| 4,042,986 A | * | 8/1977 | Goodman et al. | 5/500 |
| 4,651,370 A | | 3/1987 | Vitale | |
| 4,682,379 A | | 7/1987 | Dugan | |
| 4,734,947 A | * | 4/1988 | Vitale | 5/493 |
| 4,777,677 A | | 10/1988 | Dugan | |
| 4,985,953 A | | 1/1991 | Seago | |
| 5,325,555 A | | 7/1994 | Whitley | |
| 5,530,979 A | | 7/1996 | Whitley | |
| 5,625,912 A | | 5/1997 | McCain et al. | |
| 5,809,593 A | | 9/1998 | Edwards | |
| 5,882,769 A | * | 3/1999 | McCormack et al. | 428/152 |
| 5,996,148 A | | 12/1999 | McCain et al. | |
| 6,041,456 A | | 3/2000 | Pharr | |
| 6,226,815 B1 | | 5/2001 | Mink et al. | |

* cited by examiner

*Primary Examiner*—Teri Pham Luu
(74) *Attorney, Agent, or Firm*—Akin Gump Strauss Hauer & Feld, LLP

(57) ABSTRACT

A fitted mattress pad for covering the top and sides of a mattress includes a first layer of material, a second layer of material and a layer of batting intermediate the first and second layers. The pad also comprises a skirt for covering the sides and ends of a mattress. One of the first and second layers is generally sized to a peripheral dimension to form the top platform of a mattress pad. The batting layer is generally sized to a peripheral dimension to form the top platform of a mattress pad. The skirt is an integral extension of one of the first or second layers of the mattress pad. The first layer, second layer and batting layer are joined together to form a unitary mattress pad.

20 Claims, 4 Drawing Sheets

FITTED MATTRESS PAD AND METHOD OF FORMING A FITTED MATTRESS PAD

BACKGROUND OF THE INVENTION

The present invention relates generally to mattress pads for protecting mattresses and more particularly to fitted mattress pads formed with less fabric materials and capable of a better fit with mattresses of standard top surface size and range of heights.

Mattress pads are commonly used and are available in various forms. Among the most common forms of mattress pad is one having a quilted top platform and a side skirt of a material that is cut in one or more panels and sewn to fit a standard size mattress, such as twin, full, queen, king or California king. This type of mattress pad usually has an elastic band or cord attached partly or wholly around the lower periphery of the skirt to retain the pad on the mattress by drawing the lower edge of the skirt under the mattress. The quilted top of the mattress pad, referred to as the top platform, is sized to cover the top of the mattress and is joined to the skirt which, is differently constructed. The skirt is usually of a height sufficient to fully cover the sides and ends of the mattress and extend under the mattress. The height of the skirt is sized to fit all or substantially all mattress heights. The problem with mattress pads of this construction is a matter of fit. More particularly, it is a matter of loose fit of the skirt which expresses itself as a baggy or puffy appearance and an unwanted shifting of the top platform on the mattress pad. Various attempts have been made to overcome the problem but they are not entirely successful. Typically, the problem is addressed by joining elastic material in various forms to the non-elastic skirt material. Some mattress pads join a single elastic band intermediate the top and bottom of the skirt. The band extends longitudinally around the periphery of the skirt to form a gathered material that can be stretched over the sidewall of the mattress. See U.S. Pat. No. 6,353,947. Another construction uses a plurality of spaced apart elastic cords each extending longitudinally around the periphery of the skirt. The cords are positioned generally across the full height of the skirt and form gathers in the skirt material. The mattress pad is fitted on the mattress by stretching the corded skirt material over the sidewalls. The individual cords at least partly grip the sidewalls of the mattress. See U.S. Pat. No. 4,985,953. Still another mattress pad construction elasticizes the sidewalls by sewing or ultrasonically bonding a sheet of elastic material to the skirt material. See U.S. Pat. No. 4,962,546. Usually this type of skirt is made in a three layer construction comprising an inner and outer layer of fabric and an intermediate layer of elastic material. Each construction is intended to gather the skirt and prevent the top platform from shifting position on the top surface of the mattress by at least partly gripping the mattress.

The difficulty with the foregoing constructions is that they do not really address the root cause of the problem which is the fact that the skirt is longer than the periphery of the mattress except where it is joined to the top platform. Thus, the skirt itself does not grip the sides and ends of the mattress except when it is combined with an elastic as described above. Even then, the gripping action takes place principally at the corners of the mattress.

The reason the skirt is longer than the periphery of the mattress is a direct result of having to join the skirt to the top platform. More particularly, it is a consequence of having to join together two dissimilar fabric materials. In sewing the thinner skirt material fabric to the multi-layer and therefore thicker quilted platform, the tendency is for the skirt material to bunch as it is stitched to the platform. Consequently, several more inches of skirt material are used than the actual perimeter dimension of the platform. Thus the actual perimeter dimension of the skirt is longer than the perimeter dimension of the platform and hence the mattress everywhere throughout the height of the skirt except at or just adjacent to the place where the skirt and platform are joined together. Therefore, the skirt fits loosely over the side and end walls of the mattress. While the conventional elastic at the bottom edge of nearly all mattress pads, including the elasticized skirts described above, functions to pull the skirt under the mattress and partly facilitates retention of the pad, there ordinarily is insufficient force to completely overcome the fullness or blousing of the skirt. In addition, the excess skirt material is wasteful.

As noted above, it is common practice to incorporate elastic material into the skirt or sidewall of the pad in addition to the conventional elastic in the bottom hem. This additional elastic tends to hold the mattress pad in place and make the skirt look like it fits tightly against the sidewall and ends of the mattress but the incorporation of elastic material into the skirt adds cost in the form of additional labor and materials.

Another way of preventing the mattress from shifting and of taking up the excess skirt material is to strengthen the elastic at the bottom edge of the skirt so that it pulls the skirt against the sidewalls with greater force. This also adds cost and, more importantly, has the disadvantage of making it more difficult to install and remove the mattress pad because of the requisite force needed to overcome the pulling power of the elastic.

Since there is little variance in the perimeter dimension of mattresses from manufacturer to manufacturer within a given category (i.e., twin, full, queen, king or California king) it is possible to provide a mattress pad skirt as an uninterrupted continuation of the top platform. In other words, the mattress pad is made like a conventional fitted sheet except it is fully quilted on the top, sides and ends. See U.S. Pat. No. 4,338,693. This mattress pad structure fits well because the corners can be formed and sewn together for snug fit of the skirt. Moreover, any shift in the mattress pad position is of little consequence because it is fully quilted. However, a fully quilted mattress pad is more costly to manufacture because it uses additional quilting materials for sidewalls which serve no functional purpose as padding.

What is needed but not provided by the prior art is a mattress pad that is fitted to a particular mattress size to allow for a snug fit without an excess of material. Further, what is needed and not provided by the prior art is a mattress pad that is formed with less steps and manual handling in order to reduce manufacturing costs.

BRIEF SUMMARY OF THE INVENTION

Briefly stated, the present invention comprises a fitted mattress pad for covering the top and sides of a mattress. More particularly, the pad provides a good, snug fit that minimizes shifting of the pad. The pad includes a first layer of fabric material, a second layer of fabric material and a layer of batting intermediate the first and second layers. The pad also comprises a skirt for covering the sides and ends of a mattress. One of the first and second layers is generally sized to a peripheral dimension to form the top platform of a mattress pad. The batting layer is generally sized to a peripheral dimension to form the top platform of a mattress pad. The skirt is an integral extension of one of the first or second layers of the mattress pad. The first layer, second layer and batting layer are joined together to form a unitary mattress pad.

The present invention also comprises a fitted mattress pad that includes a first layer of fabric material, a second layer of fabric material and a layer of batting intermediate the first and second layers. The pad also comprises a skirt for covering the sides and ends of a mattress. One of the first and second layers is generally sized to at least a peripheral dimension approximating the top dimension of a mattress. The batting layer is generally sized to at least a peripheral dimension approximating the top dimension of a mattress. The skirt is an integral extension of one of the first or second layers of the mattress pad. The first layer, second layer and batting layer are joined together to form a unitary mattress pad.

The present invention also comprises a fitted mattress pad for covering the top and sides of a mattress. The pad includes a first layer of fabric material, a second layer of fabric material and a skirt for covering the sides of a mattress. One of the first or second layers is generally sized to a peripheral dimension approximating the top dimension of a mattress. The skirt is an integral extension of one of the first or second layers of the mattress pad. The first layer and second layer are joined together to form a unitary mattress pad.

The present invention also comprises a fitted mattress pad for covering the top and sides of a mattress. The pad includes a first layer of fabric material, a second layer of fabric material, and a layer of batting joined to one of the first or second layers. The pad also includes a skirt for covering the sides and ends of a mattress. One of the first or second layers is generally sized to at least a peripheral dimension approximating the top dimension of a mattress. The batting layer is generally sized to at least a peripheral dimension approximating the top dimension of a mattress. The skirt is an integral extension of one of the first or second layers of the mattress pad. The batting layer and the layer joined thereto are joined to the other of the first and second layers to form a unitary mattress pad.

The present invention also comprises a method for forming a fitted mattress pad. The fitted mattress pad includes a first layer of fabric material, a second layer of fabric material, a layer of batting intermediate the first and second layers and a skirt for covering the sides of a mattress. The method comprises placing the layer of batting on the first layer of material such that the outer edges of the batting layer are spaced generally equal distances from the outer edges of the first layer of material. The method also comprises placing the second layer of material on the layer of batting such that the outer edges of the second layer of material are spaced generally an equal distance from the outer edges of the first layer of material. The method further comprises joining at least the second layer of material to the first layer of material whereby the distance from the outer edge of the first layer to the outer edges of the second layer defines the skirt of the mattress pad, and forming corners in the skirt.

The present invention also comprises a method for forming a fitted mattress pad. The fitted mattress pad includes a first layer of fabric material, a second layer of fabric material, a layer of batting and a skirt for covering the sides of a mattress. The method comprises placing a layer of batting on the second layer of material such that the outer edges of the batting layer are generally aligned with the outer edges of the second layer of material. The method includes joining the layer of batting to the second layer of material and placing the combined second layer of material and layer of batting on the first layer of material such that the outer edges of the second layer of material are spaced from the outer edges of the first layer of material to define the skirt. The method further includes joining at least the second layer of material to the first layer of material whereby the distance from the outer edges of the first layer to the outer edges of the second layer defines the skirt of the mattress pad. The method further includes forming corners in the skirt.

The present invention also comprises a method for forming a fitted mattress pad. The fitted mattress pad includes a first layer of fabric material, a second layer of fabric material and a skirt for covering the sides of a mattress. The method includes placing the second layer of material on the first layer of material such that the outer edges of the second layer of material are spaced generally an equal distance from the outer edges from the first layer of material. The method also includes joining at least the second layer of material to the first layer of material whereby the distance from the outer edges of the first layer to the outer edges of the second layer defines the skirt of the mattress pad, and forming corners in the skirt.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
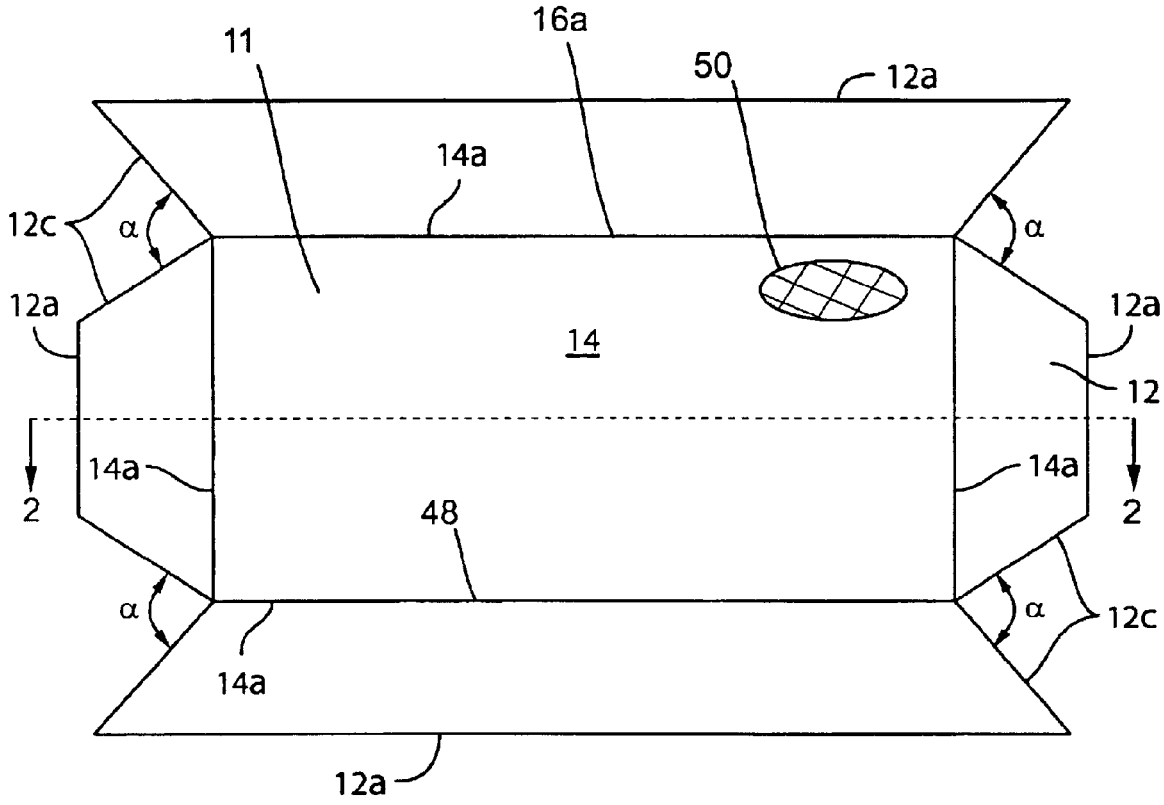
FIG. 1 is a top plan view of a fitted mattress pad just prior to being sewn in accordance with a preferred embodiment of the present invention.
Figure 2:
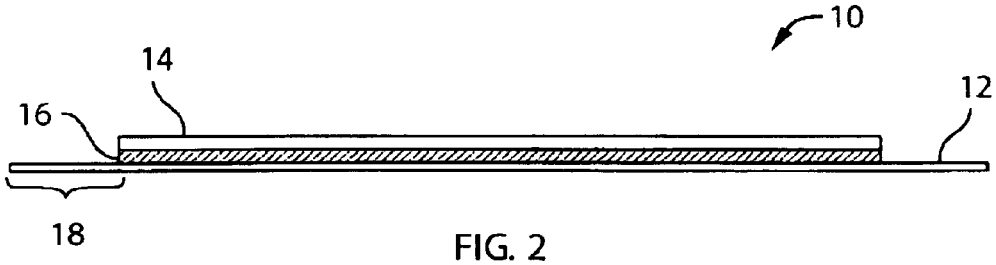
FIG. 2 is a side elevational view of the fitted mattress pad of FIG. 1.
Figure 3:
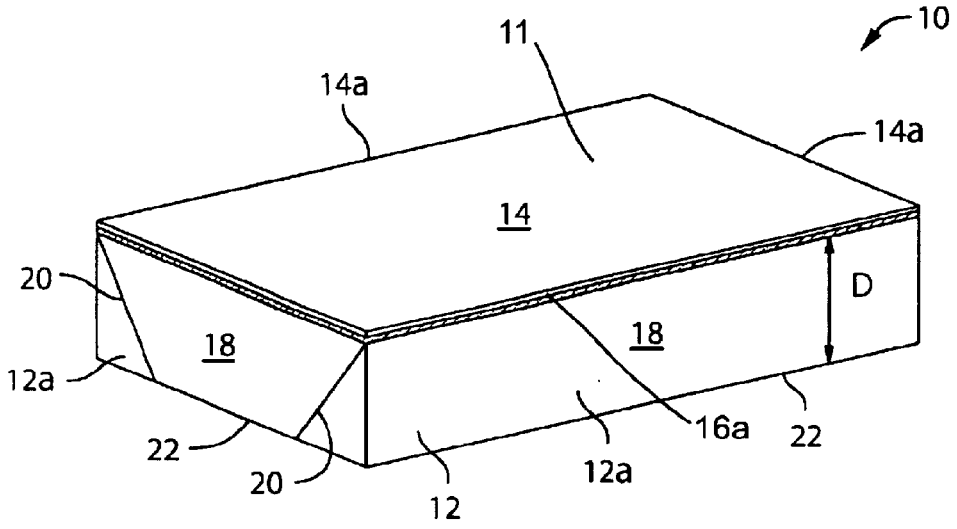
FIG. 3 is a perspective view of the fitted mattress pad of FIG. 1 in final form.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the object being discussed and designated parts thereof. The terminology includes the words above specifically mentioned, derivatives thereof and words of similar import. Additionally, the word "a" where used herein includes "at least one" or "one or more."

Referring to the drawings wherein like numerals indicate like elements, there is shown in FIGS. 1–5 a fitted mattress pad 10 in accordance with a preferred embodiment of the present invention.

A fitted mattress pad 10 for covering the top and sides of a mattress (not shown) includes a first layer of fabric material 12, a second layer of fabric material 14 and a layer of batting 16 intermediate the first and second layers 12, 14. One of the first or second layers 12, 14 is generally sized to define the platform of a mattress pad and is preferably sized to at least a peripheral dimension approximating the top dimension of a mattress. As illustrated the layer 14 is so sized. The batting layer 16 is generally sized to define the platform of a mattress pad and preferably sized to at least a peripheral dimension approximating the top dimension of a mattress.

Conventional mattress sizes include at least twin (about 39 inches wide by about 75 inches long), full (about 54 inches wide by about 75 inches long), queen (about 60 inches wide by about 80 inches long), king (about 76 inches wide by about 80 inches long) and California king (about 76 inches wide by about 84 inches long). These dimensions are preferably the approximate dimensions of the smaller of the two layers of fabric (e.g. layer 14 as shown) and the layer of batting. While the top dimensions of the conventional mattresses are fairly standard, the vertical wall dimension can vary from about 6 inches to about 15 inches or more. The present invention is not limited to conventional mattresses or standard size mattresses and may be applied to other sized and shaped mattresses as would be obvious to one skilled in the art. While the size of one of the fabric layers and the batting preferably approximates the top dimension of a mattress, it should be understood that variations in these dimensions remain within the scope of the invention. A mattress pad whose top platform dimensions were somewhat less than the mattress top dimension or somewhat more (i.e. partly drooped over the edge) would still be within the scope of the invention.

The fitted mattress pad 10 further includes a skirt 18 for covering the sides and ends of the mattress. The skirt 18 is an integral extension of one of the first or second layers 12, 14 of the mattress pad 10. Preferably, the skirt 18 is an integral extension of the first layer 12. Since the vertical or side wall of mattresses vary in height from about 6 inches to about 15 inches, the height of the skirt 18 is preferably about 15 inches so that a particular mattress pad 10 can fit the varying wall heights of mattresses of a particular standard size. For example, a twin-sized mattress pad 10 can fit a twin-sized mattress having a 6 inch wall height and can also fit a twin-sized mattress having a 15 inch wall height by simply tucking the excess skirt material underneath the mattress while still having a fitted top platform, corners and sides. Of course mattress pads 10 formed to the approximate dimension of both the platform and the side wall of a mattress can be formed without departing from the broad inventive scope of the present invention.

The first layer 12, the second layer 14 and the batting layer 16 are joined together to form a unitary mattress pad 10. Preferably, the first layer 12, the second layer 14 and the batting layer 16 are joined in a quilting pattern stitched into the layers 12, 14, 16. Preferably, the layers, 12, 14, 16 are ultrasonically bonded together in a quilting pattern 50. See for example, FIG. 3. It is contemplated that the quilting pattern may be formed by sewing the layers 12, 14, 16 together with thread as is known in the art. A line of ultrasonic or thread stitches 48 may be provided at the periphery of the pad 10 to complete the joinder of the layers and batting.

The first and second layers 12, 14 are formed of a woven, non-woven or spun material such as cotton, wool, polycotton, polymeric or synthetic fibers, flannel, satin, silk and the like and combinations thereof. The first and second layers can be made of different material. Preferably the first and second layers 12, 14 are formed of a woven or non-woven cotton/polymeric-blend. Of course, the first and second layers 12, 14 can be formed of other materials without departing from the present invention.

Batting is generally a soft, bulky assembly of fibers which are usually carded. Batting is generally used for interlinings, padding, stuffing and other thermal or resiliency applications as is known in the art. The batting layer 16 is formed of a non-woven material such as cotton, wool, polymeric or synthetic fibers or the like and combinations thereof forming a multi-layer, semi-open structure. Preferably, the batting layer 16 is formed of a non-woven polymeric fiber material such as polyester fiber. Of course, the batting layer 16 can be formed of other materials without departing from the present invention. It is also contemplated that the batting layer 16 may be a padding of foamed polymer, feathers, loose fibers or the like.

It is contemplated that the second layer of material 14 and the batting layer 16 are sewn or quilted to an underside of the first layer of material 12 such that the face side of the second layer of material 14 will be closest to the mattress and is within the area defined by the skirt 18 and the rest of the first layer of material 12.

Preferably, the second layer of material 14 and the batting layer 16 are substantially rectangularly shaped similar to commercially available mattresses as are known in the art. However, the second layer of material 14 and the batting layer 16 may also be round or other shapes to complement mattresses of other shapes without departing from the broad inventive scope of the present invention. The skirt 18 is an integral extension of the layer 12 or 14. However, the skirt 18 may be an integral extension of the layer 12 or 14 which is in direct contact with the top surface of the mattress.

It is contemplated that the first or second layer of material 12, 14 itself may be a batting material, a quilted material or a padded material such that the mattress pad 10 does not require the additional batting layer 16.

Figure 4:
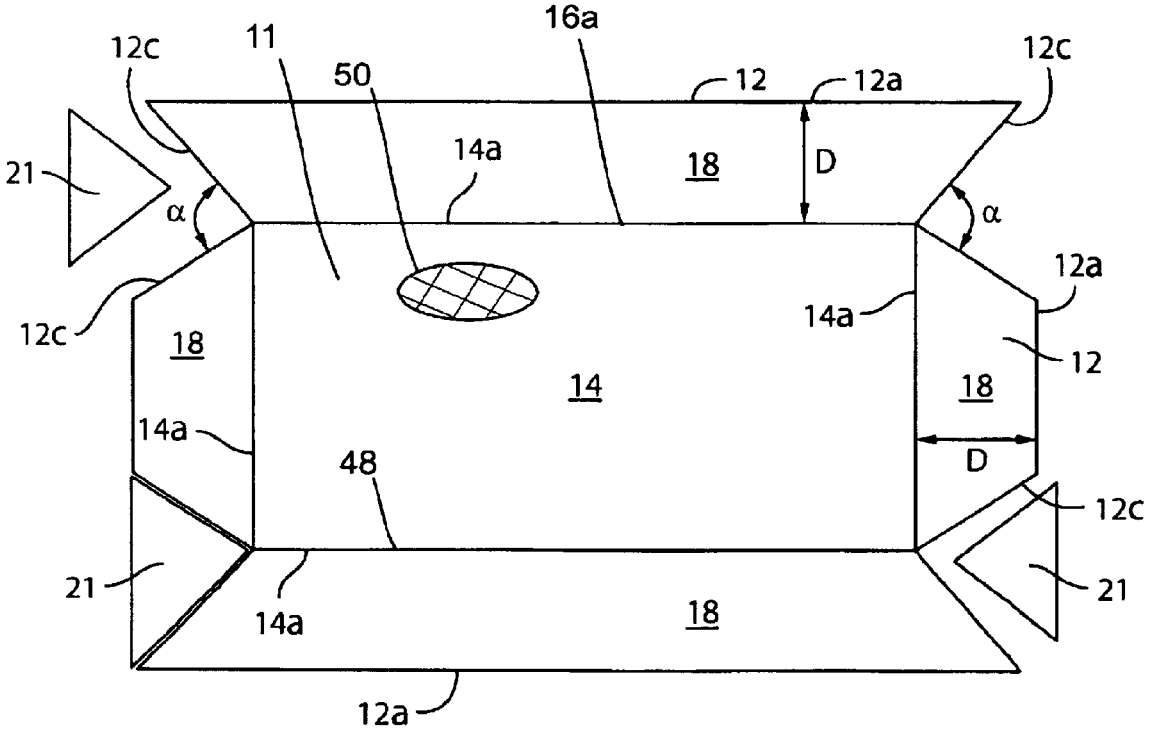
FIG. 4 depicts the fitted mattress pad of FIG. 1 having material near the corners removed.
Figure 7:
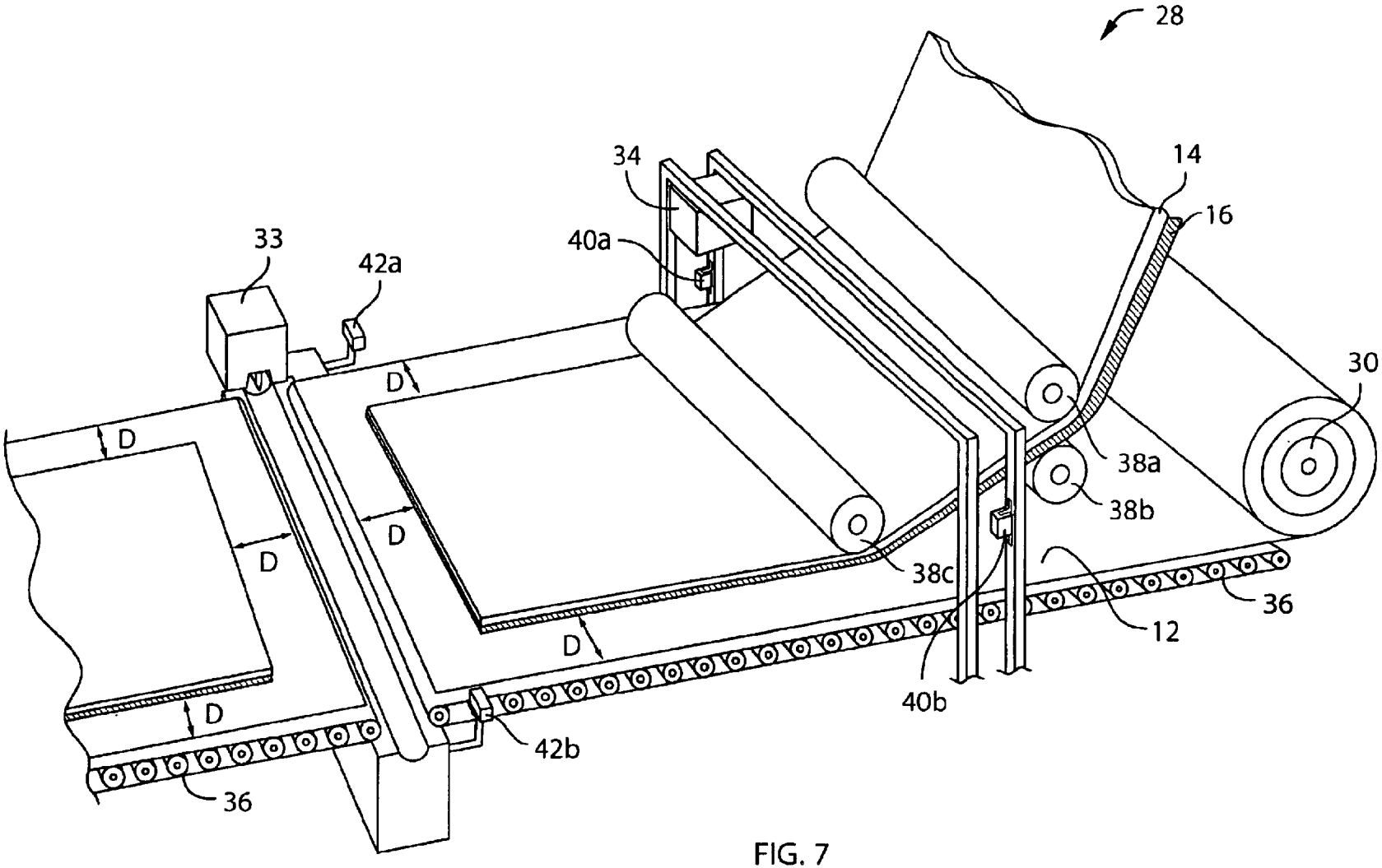
FIG. 7 depicts a process of forming fitted mattress pads in accordance with the present invention.

Referring to FIGS. 4 and 7, in order to form a fitted mattress pad 10 in accordance with the present invention including a first layer of material 12, a second layer of material 14, a layer of batting 16 intermediate the first and second layers 12, 14 and a skirt 18 for covering the sides and ends of a mattress, the batting layer 16 is placed on the first layer of material 12 such that the outer edges 16*a* of the batting material 16 are spaced generally equal distances D from each of the outer edges 12*a* of the first layer of material 12. The second layer of material 14 is placed on the layer of batting 16 such that the outer edges 14*a* of the second layer of material 14 are spaced generally equal distances D from the outer edges 12*a* of the first layer of material 12. At least the second layer of material 14 is joined to the first layer of material 12, preferably by ultrasonic or conventional stitching, whereby the distance D from the outer edges 12*a* of the first layer 12 to the outer edges 14*a* of the second layer 14 generally defines the skirt 18 of the mattress pad 10. Corners 20 are formed in the skirt 18. Preferably, the corners 20 are formed by removing a piece 21 of the first layer of material 12 creating a space with an internal angle $\propto$ between internal corner edges 12*c* such that the remaining portions of the first layer of material 12 can be folded and sewn or otherwise joined so as to form a tight corner 20

Figure 5:
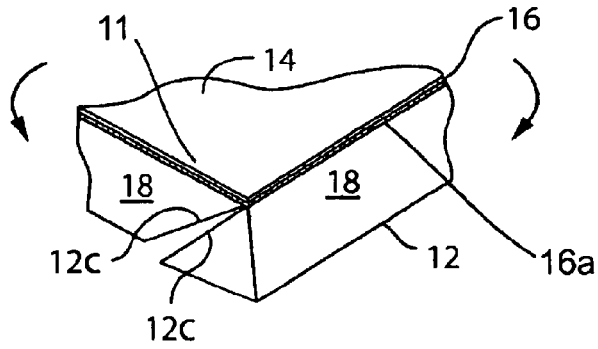
FIG. 5 is a perspective view of the fitted mattress pad of FIG. 1 having the sides partly folded to form corners.

(FIG. 5). Preferably, the angle ∝ is approximately 45° so that the pad 10, when fully sewn, forms a triangle like structure. See FIG. 3.

Figure 6:
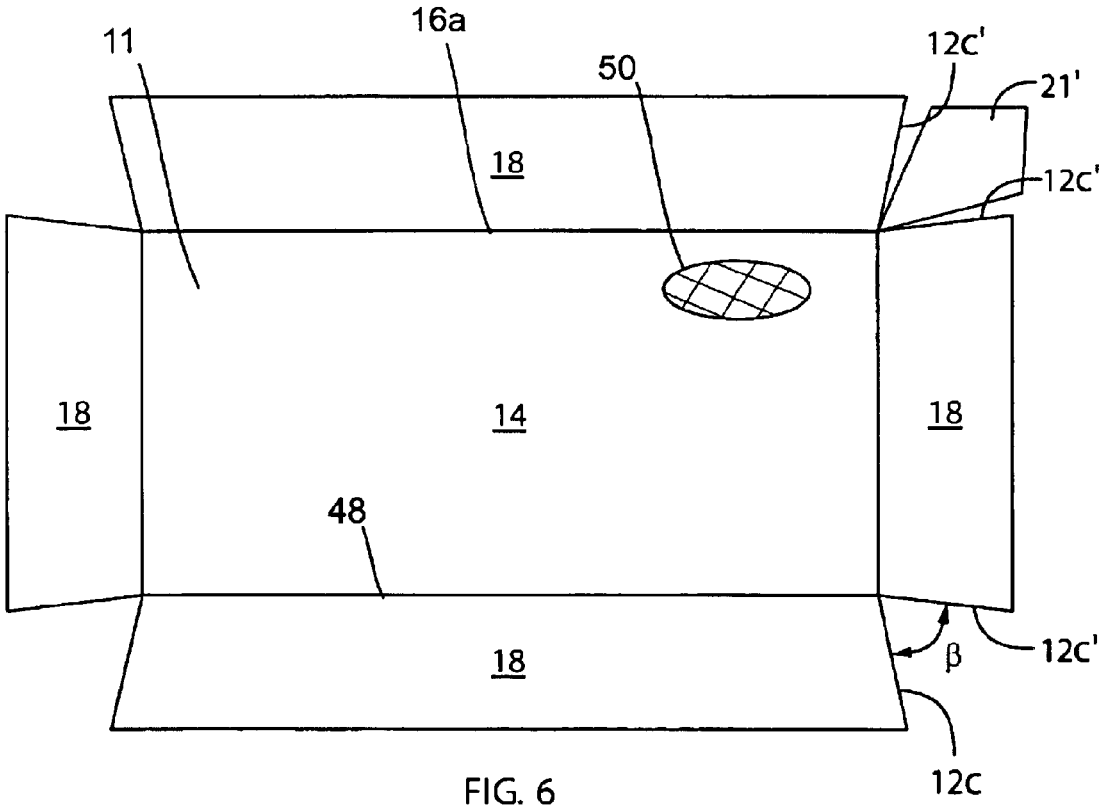
FIG. 6 is a top plan view of a fitted mattress pad just prior to being sewn in accordance with an alternate embodiment of the present invention.

In an alternate embodiment shown in FIG. 6, a smaller portion 21' of the first layer of material 12 is removed to create a smaller space with a smaller internal angle β between internal corner edges 12*c*'. Of course other shapes and sizes of material may be removed or no material may be removed to form the corners 20 by folding in different manners and/or configurations without departing from the present invention.

An elastic strip of material 22 is secured along at least a portion of the outer edges 12*a* of the first layer 12. Preferably, the elastic strip of material 22 is secured along the entire outer edge 12*a* of the first layer 12.

Since the skirt 18 and the first layer of material 12 are an integral piece of material, there is no sewing step required at an interface of the skirt 18 and the top platform of the mattress pad 10 so a significant amount of material is saved because there is no resultant gathering of the skirt material 18. Additional material is saved because there is no cut-off of material at such seams. Since the platform 11 and skirt 18 are integrally formed, there is no gathering of the material forming the mattress pad 10 and the result is a generally tight fitting mattress pad 10 without a baggy side skirt. Significantly, the skirt truly fits the sides and ends of the mattress and therefore grips it without the aid of supplemental elastic.

In an alternate and preferred method of forming a mattress pad 10, the layer of batting 16 is placed on the second layer 14 such that the outer edges 16*a* of the batting layer 16 are generally aligned with the outer edges 14*a* of the second layer of material 14. The layer of batting 16 is joined to the second layer of material 14. Preferably, the layer of batting 16 is joined to the second layer of material 14 by ultrasonically bonding a quilting pattern into the fabric material, but the layer of batting 16 may be joined to the second layer of material 14 by other means such as a quilting pattern sewn by thread or the like without departing from the present invention. The combined second layer of material 14 and layer of batting 16 are placed on the first layer of material 12 such that the outer edges 14*a* of the second layer of material 14 are spaced at generally equal distances D from the outer edges 12*a* of the first layer of material 12 to define the skirt 18. At least the second layer of material 14 is joined to the first layer of material 12 whereby the distance from the outer edge of the first layer 12 to the outer edges 14*a* of the second layer 14 define the skirt 18 of the mattress pad 10. Preferably the combined second layer 14 and batting are joined to the layer 12 by a line of stitches 48 formed by thread or ultrasonic bonding. Corners 20 are formed in the skirt 18 and the edges of the corners are joined by sewing with thread as is known in the art.

An apparatus 28 is depicted in FIG. 7 including a roll 30 of the first layer of material 12, various platform feeder rollers 38*a*, 38*b*, 38*c*, conveyer belts 36, placement sensors 40*a*, 40*b*, 42*a*, 42*b*, and cutters or knives 33, 34. However, the apparatus 28 is not critical to the present invention and therefore, other configurations and apparatuses for forming such fitted mattress pads may be used without departing from the present invention.

From the foregoing it can be seen that the present invention comprises a fitted mattress pad including at least first and second layers of material, and preferably a batting layer, configured to minimize wasted material and steps of formation thereof. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A fitted mattress pad for covering the top and sides of a mattress, the pad comprising:

a first layer of material;

a second layer of material;

a layer of batting intermediate the first and second layers; and a skirt for covering the sides and ends of a mattress; and one of the first or second layers being sized to approximately a peripheral dimension approximating the top dimension of a mattress;

the batting layer being sized to approximately a peripheral dimension approximating the top dimension of a mattress;

the skirt being an integral extension of one of the first or second layers of the mattress pad;

the first layer, second layer and batting layer being joined together to form a unitary mattress pad.

2. The fitted mattress pad according to claim 1, wherein the first layer, second layer and the batting layer are joined in a quilting pattern sewn into the layers.

3. The fitted mattress pad according to claim 2, wherein the quilting pattern is formed by ultrasonically bonding the layers together.

4. The fitted mattress pad according to claim 2, wherein the quilting pattern is formed by stitching the layers together with thread.

5. The fitted mattress pad according to claim 1, wherein at least the second layer of material and the batting layer are substantially rectangularly-shaped.

6. The fitted mattress pad according to claim 1, wherein at least the second layer of material and the batting layer are round.

7. The fitted mattress pad according to claim 1, wherein the skirt is an integral extension of the outermost layer relative to the mattress.

8. The fitted mattress pad according to claim 1 further comprising an elastic strip on at least a portion the outer edge of the first layer.

9. A fitted mattress pad for covering the top and sides of a mattress, the pad comprising:

a first layer of material;

a second layer of material; and a skirt for covering the sides of a mattress;

one of the first or second layers being generally sized to a peripheral dimension approximating the top dimension of a mattress;

the skirt being an integral extension of one of the first or second layers of the mattress pad;

the first layer and second layer being joined together to form a unitary mattress pad.

10. The fitted mattress pad of claim 9, wherein the layer that does not form the skirt is a quilted material.

11. A fitted mattress pad for covering the top and sides of a mattress, the pad comprising:

a first layer of material;

a second layer of material;

a layer of batting joined to one of the first or second layers; and a skirt for covering the sides and ends of a mattress;

one of the first or second layers being sized to approximately a peripheral dimension approximating the top dimension of a mattress;

the batting layer being sized to approximately a peripheral dimension approximating the top dimension of a mattress;

the skirt being an integral extension of one of the first or second layers of the mattress pad;

the batting layer and the layer joined thereto being joined to the other of the first and second layers to form a unitary mattress pad.

12. A fitted mattress pad for covering the top and sides of a mattress in accordance with claim 11 wherein the batting layer is joined to the first layer or to the second layer by a pattern of stitches.

13. A method for forming a fitted mattress pad, the fitted mattress pad including a first layer of material, a second layer of material, a layer of batting intermediate the first and second layers and a skirt for covering the sides of a mattress, the method comprising the steps of:

placing the layer of batting on the first layer of material such that the outer edges of the batting layer are spaced generally equal distances from the outer edges of the first layer of material;

placing the second layer of material on the layer of batting such that the outer edges of the second layer of material are spaced generally an equal distance from the outer edges of the first layer of material;

joining at least the second layer of material to the first layer of material whereby the distance from the outer edges of the first layer to the outer edges of the second layer defines the skirt of the mattress pad; and forming corners in the skirt near the outer edges of the first layer.

14. The method according to claim 13 further comprising the step of:

securing an elastic strip of material along at least a portion of the outer edges of the first layer.

15. The method according to claim 13, wherein the second layer is joined to the first layer by ultrasonic bonding.

16. The method according to claim 13, wherein the second layer is secured to the first layer by sewing.

17. A method for forming a fitted mattress pad, the fitted mattress pad including a first layer of material, a second layer of material, a layer of batting and a skirt for covering the sides of a mattress, the method comprising the steps of:

placing the layer of batting on the second layer of material such that the outer edges of the batting layer are generally aligned with the outer edges of the second layer of material;

joining the layer of batting to the second layer of material;

placing the combined second layer of material and layer of batting on the first layer of material such that the outer edges of the second layer of material are spaced from the outer edges of the first layer of material to define the skirt;

joining at least the second layer of material to the first layer of material whereby the distance from the outer edges of the first layer to the outer edges of the second layer defines the skirt of the mattress pad; and forming corners in the skirt.

18. The method for forming a fitted mattress pad according to claim 17, wherein the layer of batting is intermediate the first and second layers.

19. A method for forming a fitted mattress pad, the fitted mattress pad including a first layer of material, a second layer of material, and a skirt for covering the sides of a mattress, the method comprising the steps of:

placing the second layer of material on the first layer of material such that the outer edges of the second layer of material are spaced generally an equal distance from the outer edges of the first layer of material;

joining at least the second layer of material to the first layer of material whereby the distance from the outer edges of the first layer to the outer edges of the second layer defines the skirt of the mattress pad; and forming corners in the skirt near the outer edges of the first layer.

20. A fitted mattress pad for covering the top and sides of a mattress, said pad comprising:

a first layer of material;

a second layer of material;

a layer of batting intermediate the first and second layers; and a skirt for covering the sides and ends of a mattress;

one of the first or second layers being generally sized to form the top platform of a mattress pad;

the batting layer being generally sized to form the top platform of a mattress pad;

the skirt being an integral extension of one of the first or second layers of the mattress pad; and the first layer, second layer and batting layer being joined together to form a unitary mattress pad.

* * * * *